United States Patent [19]

Arber

[11] Patent Number: 4,868,800

[45] Date of Patent: Sep. 19, 1989

[54] ADVANCED DATE WARNING SYSTEM

[76] Inventor: Amihadar Arber, 8720 Karlov Ave., Skokie, Ill. 60076

[21] Appl. No.: 275,270

[22] Filed: Nov. 23, 1988

[51] Int. Cl.[4] ..... G04B 19/24

[52] U.S. Cl. ..... 368/29; 368/41; 368/43

[58] Field of Search ..... 368/28–30, 368/41–43, 72–74, 250; 40/107, 110

[56] References Cited

U.S. PATENT DOCUMENTS

| | | | |
|---|---|---|---|
| 4,630,934 | 12/1986 | Arber | 368/28 |
| 4,708,490 | 11/1987 | Arber | 368/28 |
| 4,709,498 | 12/1987 | Sapp | 368/28 X |
| 4,774,697 | 9/1988 | Alhara | 368/41 |

*Primary Examiner*—Vit W. Miska

*Attorney, Agent, or Firm*—Silverman, Cass, Singer & Winburn, Ltd.

[57] ABSTRACT

An electronic advanced date warning system including a base having a front surface, a first member associated with the front surface for lighting selected date warning areas thereon, a second member associated with the front surface for lighting selected areas thereon corresponding to specific categories of events associated with the selected date warning areas of the first member, and a member for selectively activating and deactivating both of the first and second lighting members to provide the advanced date warnings and associated event indicators. The system can include an enlarged front surface exhibiting conventional calendar information indicia that can be used in conjunction with the first member.

19 Claims, 1 Drawing Sheet

FIG. 1
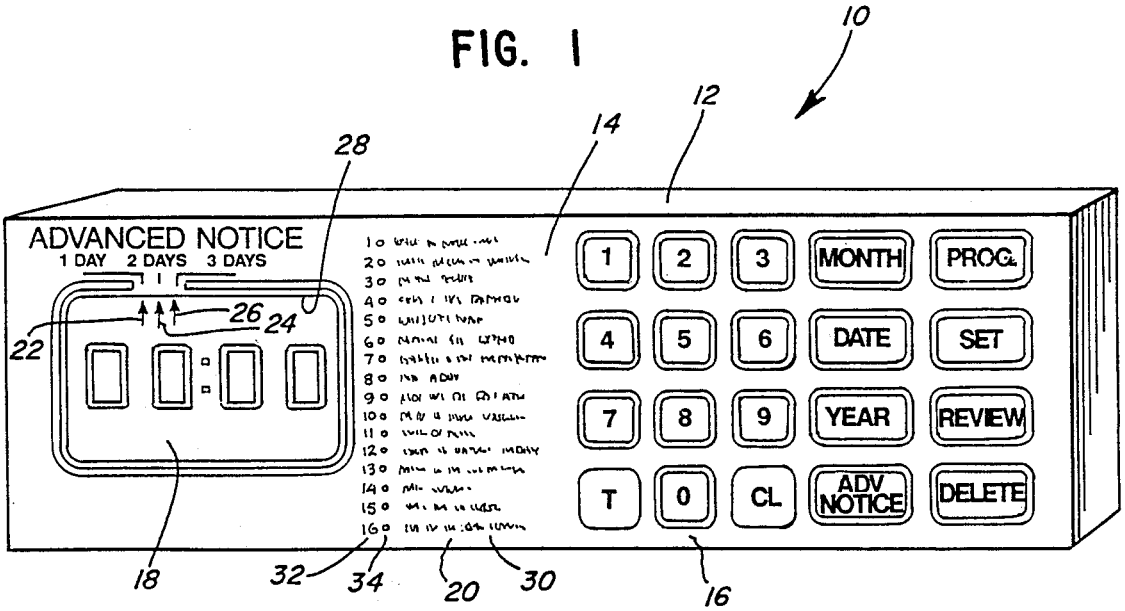
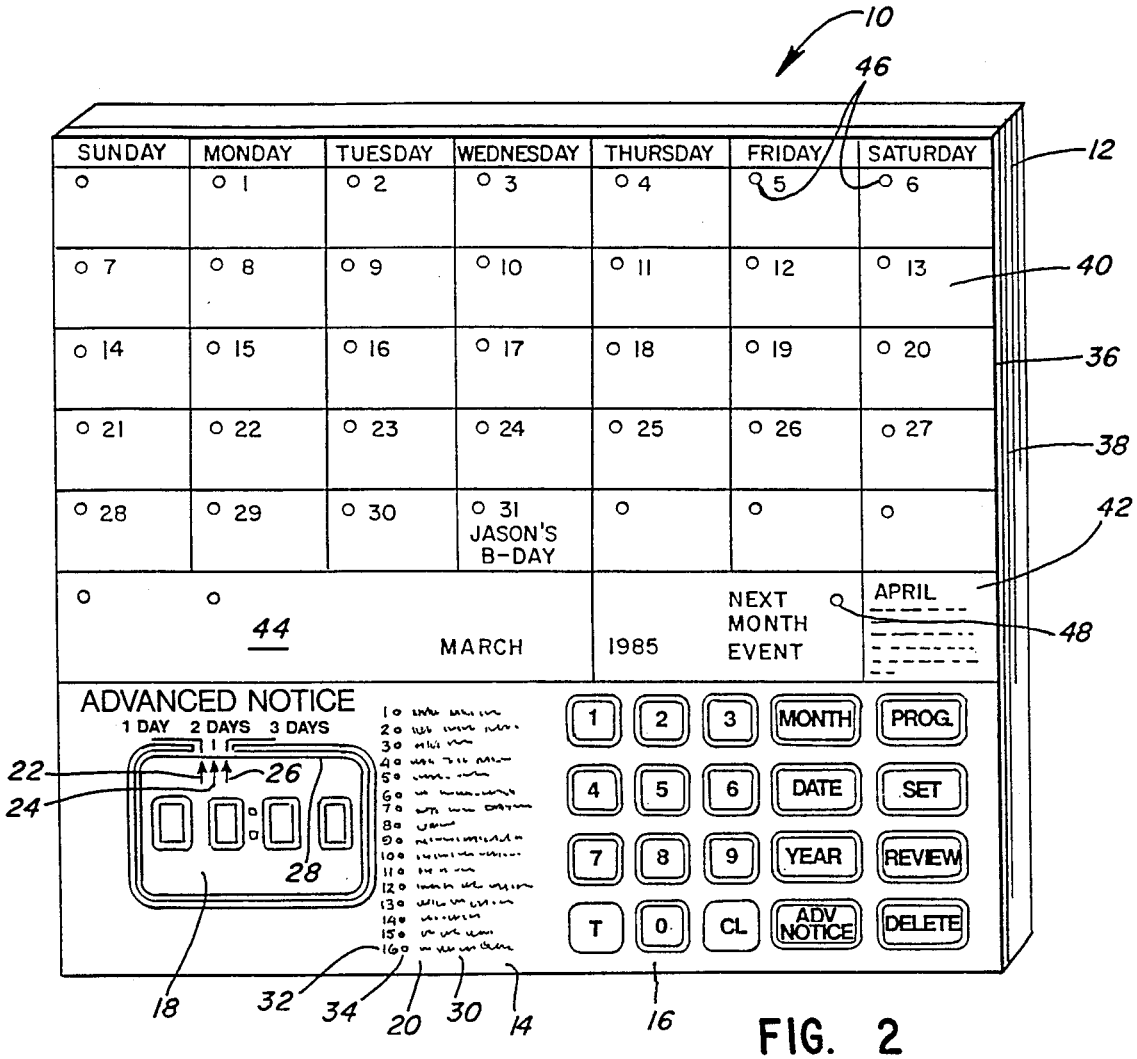
FIG. 2

ADVANCED DATE WARNING SYSTEM

BACKGROUND OF THE INVENTION

The present invention relates generally to an electronic advanced date warning system that can include a calendar and more particularly to a visual and/or audible date warning system that can attract the attention of a user to specific times before and including the date of interest as well as identifying the specific category of event or events occurring on such dates.

Advanced date warning systems are generally known. Examples of such systems are disclosed in U.S. Pat. Nos. 4,630,934 and 4,708,490, both of which have issued in the name of the inventor of the present application and are hereby incorporated by reference.

These systems typically provide advanced warnings for a preselected number of days prior to the selected dates in a distinguishing visual and/or audible way. Personal computers provide means of storing and retrieving events on a daily basis to serve as a date minder. Personal computers, however, lack the most important feature of being able to make manual entries with a common writing instrument without the use of an alpha-numeric keyboard. Consequently, people still prefer the conventional paper calendars which provide ease of entering and an instant visual indication of events to come. Writing on a calendar, however, does not provide any special warning of an important date.

It would therefore be advantageous to provide an ordinary person with a simple, inexpensive system with a calendar format in which the user can have an advanced warning of important approaching dates. The system also identifies the particular type or category of event occurring on that date while still providing an area for jotting down other information.

SUMMARY OF THE INVENTION

The above and other disadvantages of the prior art are overcome in accordance with the present invention by providing an electronic advanced date warning system which provides a visual and/or an audio warning signal and can be designed as a stand alone unit and includes a base having a front surface. The system provides quick entry and revision of the warnings and includes a first member associated with the front surface for lighting selected date warning areas thereon corresponding to specific advanced warning intervals, a second member associated with the front surface for lighting selected areas thereon corresponding to specific categories of events associated with the selected date warning areas of the first member, a circuit for selectively activating and deactivating both of the first and second lighting members, and a control and memory for programming the circuit to provide the advanced date warnings and associated event indications. The system can also include an enlarged front surface exhibiting conventional calendar information indicia that can be used in conjunction with the first member.

BRIEF DESCRIPTION OF THE DRAWINGS

FIG. 1 is a schematic front view of an advanced date warning system according to the invention; and FIG. 2 is a schematic front view of another embodiment of the system of the present invention illustrated in conjunction with a calendar.

DESCRIPTION OF THE PREFERRED EMBODIMENT

Referring to FIG. 1, the date warning system of the present invention is designated generally by reference numeral 10. The system 10 includes a base 12 on the front surface of which there is a keyboard and display area 14.

The keyboard and display area 14 of the base 12 includes a keyboard 16, a display 18, and a column of events of categories of events 20. The keyboard 16 includes keys bearing numerical and alphabetical indicia O-9, T, CL, MONTH, DATE, YEAR, ADV.NOTICE, PROG., SET, REVIEW, and DELETE. The abbreviations on the keys denote as follows:

T-enters start-up time
CL-clears prior entries
MONTH-enters the desired month
DATE-enters the desired date
YEAR-enters the desired year
ADV.NOTICE-advanced notice entry
PROG.-program mode to enter future dates into calendar's memory
SET-made to set the start-up date and time
REVIEW-review mode-to review entries of future dates
DELETE-delete mode-to delete any date entry In addition to the clock/calendar digits displayed by the display 18, which is preferably an LCD, three indicators or arrows 22, 24, and 26 preferably are included within the LCD 18 around its top perimeter 28 to provide an advanced date warning indication. The indicators 22, 24, and 26 line up with indicia on the face of the display area 14, such as, for example, advanced notice of 1 day, 2 days, and 3 days respectively. Accordingly, the indicator 26 will be activated to indicate that a programmed date will occur in three days, the indicator 24 will be activated to indicate that a programmed date will occur in two days, and the indicator 22 will be activated to indicate that a programmed date will occur in one day.

If desired, the indicators 22, 24, and 26 can be different colors, can blink at different rates or have different audio signals to provide further differentiation between the warning dates. Additionally, the indicators 22, 24, and 26 can be positioned at different areas around the perimeter of the LCD 18, can be separate from the LCD 18, and can be LED's, lamps, or other visual indicia.

The column of events 20 can be positioned between the keyboard 16 and the LCD 18 and can include a listing of categories of common events 30 having a corresponding column of numerals 32 and a corresponding column of LED's 34. In the embodiment illustrated, 16 events are listed but can vary. As an example, the following is a list of categories of events numbered 1–17 that are preferably included in the column of events 20:

1. BIRTHDAYS & ANNIVERSARIES
2. SHOWS, CONCERTS & ENTERTAINMENT
3. TV "MUST" VIEWING
4. MEDICAL & DENTAL APPOINTMENTS
5. LUNCHEONS & DINNERS
6. PARTIES & SOCIAL ENGAGEMENTS
7. CHILDREN & SCHOOL-RELATED ACTIVITIES
8. FAMILY AFFAIRS
9. JOB AND WORK-RELATED ACTIVITIES

10. CHURCH & COMMUNITY FUNCTIONS
11. TRAVEL & VACATIONS
12. LECTURES & PROFESSIONAL FUNCTIONS
13. BOND & INVESTMENTS MATURITY
14. NOTES & PAYMENTS
15. LEASES & LEGAL MATTERS
16. DEADLINES & EXPIRATION DATES
17. OTHERS (NOT ILLUSTRATED)

Accordingly, when a date and the number of days of advanced warning are programmed, the type of event corresponding to that date can also be programmed. This eliminates the need to write down anything at all by hand and provides an indication of the category of the event at a location within the keyboard/display area 14.

As FIG. 2 illustrates, the base 12 can also be enlarged to include a calendar section 36 that includes a removable sheet 38 exhibiting standard calendar information indicia. The indicia can include either preprinted or jotted-down information relating to the days of the week and the dates of the particular month shown. The dates of the month are within the boundaries of marked areas 40. Advantageously there is also provided an area 42 displaying calendar information with regard to the month following the particularly displayed month. The sheet 38 has a further defined field 44 in which the name of the displayed month and year are depicted and may include further desired information.

The removably interchangeable sheet 38 may be provided without the designation of the days of the week appearing at the top line thereof. Instead, this information may be permanently written on the base 12 or even more advantageously, it may be depicted on a resilient strip of material which can serve as a clamp for affixing of the periodically changeable sheet 38.

As FIG. 2 illustrates, each of the areas 40 includes a light emitting element 46, for example, a light emitting diode (LED) strategically mounted on the calendar section 36 of the base 12 so that they partially protrude through apertures correspondingly provided in the sheet 38, when the latter is properly affixed to the base 12.

The sheet 38 is preferably made of paper to enable the user to write thereon as is done on any suitable conventional jot-down calendar. Alternatively, the sheet 38 can be made of at least a semi-transparent material, such as plastic, on which surface it is also possible to write with suitable writing instruments.

When the sheet 38 is made of at least semi-transparent material, the areas 46 need not be provided with apertures for allowing the elements 46 to protrude therethrough. The elements 46 may, in this case, be embedded in, or otherwise affixed on, the base 12 and the light eventually emitted by the elements 46 will be noticeable through the transparent sheet placed thereon. Obviously, the intensity of light emitted by each individual LED will be calculated with respect to the size of each individual area so as to assure that the viewer will immediately be able to perceive the specific date and/or the hand written information to which attention is to be drawn.

The electrical circuit of the present invention is similar to those of the above referenced U.S. Pat. Nos. 4,630,934 and 4,708,490 and will not be explained here in detail. Generally, the 4×5 matrix keyboard is electronically connected to a microprocessor. Entries are viewed on the LCD which is connected to the microprocessor through a display driver. All dates and events which are entered by means of the keyboard are stored in a date/event memory chip. The microprocessor keeps track of time and dates by constantly referring to a real time clock/calendar unit which unit in turn is controlled for accuracy by a quartz crystal. The light emitting diodes are connected to a 6×7 light emitting element matrix, the latter being connected to, and controlled by, the microprocessor through column drivers and a multiplexer on one side, and through row drivers and a multiplexer on the other side. A program memory is also provided.

The system can also include a next month event warning indicia or lamp 48 similar in function to the LED's 46 as described above. The lamp 48 provides a warning of a date which will occur in the next month, before the current month's sheet 38 of the calendar is removed. The lamp 48 can be programmed if desired.

Accordingly, with the embodiment of FIG. 2, a user can still jot down information in the marked area 40 of the calender. Such information may include the time and place of a particular event or to label an event not specifically described within the column of category of events 30.

The operation of the system 10 is as follows: the system 10 is first energized by a battery or from a common household wall outlet and the time of day is then set by means of the keyboard 16. This setting will provide an accurate real time base and keep track of dates until, for example, the year 2048, including leap years. If, for example, the start-up date is Mar. 5, 1988, and the time is 10:30 A.M., the key-pressing sequence is as follows: SET, 3, MONTH, SET, 5, DATE, SET, 88, YEAR, SET, 1030, T. This completes the initial start-up of the calendar. At this point the LCD 18 will show the actual time of day (10:30 A.M.), and pressing the DATE key will show the actual date (3-5-88) on the LCD 18. It is to be noted that each and every entry made through the keyboard 16 will be shown on the LCD 18 in order to be able to monitor the entries and prevent errors. In case of an error, the user presses the CL key to clear the entry and provide for a new, correct entry.

When the user wants to be reminded of an important upcoming event, for example, a birthday that will occur on Mar. 31, 1988, with three days advanced notice, the user will then press the following keys: PROG, 3, MONTH, 31, DATE, 88, YEAR 3, ADV NOTICE, 1. The result will be that on March 28, three days before the programmed date, the indicator 26 will be activated and, in the 2nd embodiment, the LED 46 associated with the selected date will start blinking at a slow rate within the calendar section 36. Also, an LED in the column of LED's 34 corresponding to event Number 1, "Birthdays & Anniversaries", will be activated and begin blinking at a slow rate to indicate the type of event that is to occur on that date. On March 29, two days before the programmed date, the indicator 24 will be activated and, in the 2nd embodiment, the LED 46 associated with the selected date will start blinking at a faster rate as will the LED in the column of LED's 34. On March 30, one day before the programmed date, the indicator 22 will be activated and, in the second embodiment, the LED 46 associated with the selected date will start blinking at an even faster rate as will the LED in the column of LED's 34. On March 31, the programmed date, the LED 46 and the LED in the column of LED's 34 will stay lit. On April 1, the day after the programmed date, the LED 46 and the LED in the column of LED's 34 will turn off.

In order to change the event to be indicated, the last number entered in the above sequence is merely changed to the number corresponding to the desired event in the column of events 30. For example, if one is to be reminded of a party rather than a birthday that is to occur on Mar. 31, 1988, with three days advanced notice, the last number entered in the sequence will be 6, instead of 1. Accordingly, an LED in the column of LED's 34 corresponding to event number 6, "Parties & Social Engagements", will be activated.

It is to be understood that any of the indicators 22, 24, and 26 can be activated to blink along with the LED 46 within the calendar section 36 and the LED in the column of LED's 34. If there is more than one programmed date in the selected warning period, such as three days away and one day away, then the closest warning date takes precedence for the blinking rates of the LED 46, indicators 22, 24, and 26, or the LED's in the LED column 34.

Different event categories on the same date can thus be entered into the calendar's memory and while the LED 46 will blink or stay on, one or more LED's in the column 34 will also blink or stay on.

Additionally, an audible sound can be provided which can change in speed and pitch or both as the programmed date comes within the three day advanced warning period and advances to the programmed date. Since the blinking or audible sound can be annoyance, pressing the T and CL keys will cause the blinking and/or audible sounds to cease for that date. The system 10 will automatically restart the blinking and/or audible sounds on the next day if still appropriate. Further pressing of the keys T and CL will reactivate the blinking and/or audible sound for that date.

It is also to be noted that the next month calendar area 42 and its associated light 48 can be activated to draw attention to an event which will occur in the first days of the forthcoming month. The advanced warning signalling of the light 48 will stop on the first of the new month, LED 46 will take over blinking from light 48 for the new month. Hundreds of upcoming dates and a description of the type of event occurring on that date thus quickly can be programmed in advance in the above described manner. To delete, for example, a doctor's appointment on Mar. 31, 1988, a user merely presses keys PROG, 3, MONTH, 31, DATE, 88, YEAR 4, and DELETE. Thus, any particular programmed date/event can be deleted by entering the desired date, category of event and pressing the DELETE key without disturbing any remaining programmed events occurring in the same date.

Another feature of the present invention is the ability to enter dates which are repeated each year, such as birthdays, anniversaries, memorials, etc., only once. This is accomplished by entering the date, but skipping any reference to year. For example, if a child's birthday falls on October 17, and an advanced warning of one day is required, then the key pressing sequence is: PROG, 10, MONTH, 17, DATE, YEAR, 1, ADV NOTICE, 1. This sequence will enter the child's birthday into the calendar's memory and the user will be alerted to the birthday with one day advanced notice in each and every year until the year 2048.

Yet another feature of the present invention is the ability to review the entered dates either in chronological order or according to designated years. For example, if the user wants to review entries for B 1989, he then presses the keys: REVIEW and 89. Now, each pressing of the REVIEW key will cause the LCD 18 to exhibit the 1989 entries starting chronologically at the beginning of January and ending at the end of December.

This invention also will provide a quick review of upcoming dates and their corresponding events stored in the memory, while in the review mode, while the dates are chronologically displayedon LCD 18, each displayed date will have an LED or LED's in column 34 blinking or lit to indicate which category is associated with the date displayed on LCD 18.

It will be readily appreciated that the electronic advanced date warning system described above constitutes a simple, fast and effective way of being reminded of important upcoming events which are identified by the system 10 that also provides visual and/or audible sounds to alert a user that can also be incorporated with a familiar jot-down calendar. Additionally, today's integrated circuit technologies enable all of the circuit elements of the event memory, program memory, clock/-calendar, the multiplexers, and the micro-processor to be incorporated into a single chip.

Modifications and variations of the present invention are possible in light of the above teachings. The system 10 is illustrated as a desk unit but can be a part of other desk or wall-type units and the particular layout and structure is not critical to the described invention. It is therefore to be understood that within the scope of the appended claims, the invention may be practiced otherwise than as specifically described.

What is claimed and desired to be secured by Letters Patent of the United States is:

1. An electronic advanced date warning system, comprising:

a base having a front surface;

first means associated with said front surface for lighting selected areas thereon, said areas including a first warning area to be activated when a programmed date is reached and at least one advanced warning area to be activated in advance of said programmed date;

second means associated with said front surface for lighting selected areas thereon indicating the particular type of event associated with the selected date warning areas of said first means for lighting; and means for selectively activating and deactivating said first and second lighting means.

2. The system as defined in claim 1, wherein said means for selectively activating and deactivating said first and second lighting means is a circuit, and said system includes means for programming said circuit.

3. The system as defined in claim 1, wherein both of said first and second lighting means associated with said front surface are LED's arranged on said base.

4. The system as defined in claim 2, wherein said programming means for said circuit includes a keyboard having a plurality of individual keys, each bearing indicia selected from the group comprising the numerals zero to nine and indicia denoting the functions of entering dates, advanced warning dates, and events and the functions for setting, clearing and deleting said date entries and events.

5. The system as defined in claim 2, including a display for exhibiting information including programmed dates and associated date warning information entered into said programming means.

6. The system as defined in claim 2, wherein said circuit includes means for reviewing date warning information associated with programmed dates and events entered into said programming means.

7. The system as defined in claim 1, including means for activating said lighting areas of said second means for lighting in a manner which can be sensed at a glance by periodically varying the activation of said areas at different rates for each different warning day in advance of said programmed date.

8. The system as defined in claim 1, wherein said lighting areas of said first means for lighting include a plurality of advance warning areas with at least a first area indicating said programmed date is one day away and a second area indicating said programmed date is two days away.

9. The system as defined in claim 8, including at least a third advanced warning area indicating said programmed date is three days away.

10. The system as defined in claim 8, wherein more than one of said areas is activated when more than one programmed date is within two days of one another.

11. The system as defined in claim 1, including means for programming in a date as well as an event repeatable on a periodic basis each month or year.

12. The system as defined in claim 11, wherein said date and said event is repeatable for a selected number of months or years.

13. The system as defined in claim 1, wherein said first warning area is activated in a periodic manner to provide a blinking warning of the programmed date.

14. The system as defined in claim 1 wherein said first and second means associated with said front surface provide an audible indication.

15. The system as defined in claim 1, wherein said front surface includes an interchangeable paper sheet mounted thereon, divided into defined areas bearing calendar information indicia separate from said warning areas.

16. The system as defined in claim 15, wherein said lighting areas associated with said first means for lighting include a warning area to be activated when a programmed date is to occur within a selected number of days in the next calendar month.

17. The system as defined in claim 16, including means for activating said lighting areas of said first means for lighting and said next month warning area in a manner which can be sensed at a glance by periodically varying the activation of said areas at different rates for each different warning day in advance of said programmed date.

18. The system as defined in claim 17, wherein the closest one of the programmed dates determines the periodic activation rate of said lighting areas of said first means for lighting and said next month warning area.

19. An electronic advanced date warning system, comprising:

a base having a front surface;

first means associated with said front surface for lighting selected areas thereon, said areas including a first warning area to be activated when a programmed date is reached and a plurality of advance warning areas with at least a first area indicating said programmed date is one day away and a second area indicating said programmed date is two days away;

second means associated with said front surface for lighting selected areas thereon indicating the particular type of event associated with the selected date warning areas of said first means for lighting and including means for activating said lighting areas of said second means for lighting in a manner which can be sensed at a glance by periodically varying the activation of said areas at different rates for each different warning day in advance of said programmed date;

means for selectively activating and deactivating said first and second lighting means; and both of said first and second lighting means associated with said front surface are LED's arranged on said base.

* * * * *